US010478361B2

(12) United States Patent
Harmeyer et al.

(10) Patent No.: US 10,478,361 B2
(45) **Date of Patent: *Nov. 19, 2019**

(54) PERSON LIFTING DEVICES AND METHODS FOR OPERATING PERSON LIFTING DEVICES

(71) Applicant: Liko Research & Development AB, Luleå (SE)

(72) Inventors: John V. Harmeyer, Cleves, OH (US); Varad Narayan Srivastava, Loveland, OH (US)

(73) Assignee: LIKO RESEARCH & DEVELOPMENT AB, Luleå (SE)

( * ) Notice: Subject to any disclaimer, the term of this patent is extended or adjusted under 35 U.S.C. 154(b) by 600 days.

This patent is subject to a terminal disclaimer.

(21) Appl. No.: 15/196,504

(22) Filed: Jun. 29, 2016

(65) Prior Publication Data

US 2017/0000673 A1 Jan. 5, 2017

Related U.S. Application Data

(60) Provisional application No. 62/187,691, filed on Jul. 1, 2015.

(51) Int. Cl.
*A61G 7/10* (2006.01)

(52) U.S. Cl.
CPC ..... *A61G 7/1065* (2013.01); *A61G 7/10* (2013.01); *A61G 7/108* (2013.01); *A61G 7/1017* (2013.01);
(Continued)

(58) Field of Classification Search
CPC .. A61G 7/1065; A61G 7/1042; A61G 7/1046; A61G 7/1017; A61G 7/108;
(Continued)

(56) References Cited

U.S. PATENT DOCUMENTS 4,944,056 A 7/1990 Schroeder et al.
6,289,534 B1 9/2001 Hakamiun et al.
(Continued)

FOREIGN PATENT DOCUMENTS

EP 2684549 A2 1/2014
EP 2727571 A2 5/2014
(Continued)

OTHER PUBLICATIONS

UNIROPE Ltd; RFID Tags; [retrieved online on Jul. 11, 2013], http://www.unirope.com/chainmeshslings/rfid_tags.shtml. pp. 1-2.
(Continued)

*Primary Examiner* — Robert G Santos
*Assistant Examiner* — Myles A Throop
(74) *Attorney, Agent, or Firm* — Dinsmore & Shohl LLP

(57) ABSTRACT

A person lifting device may comprise a lift actuator operatively connected to an accessory coupling. The person lifting device may also comprise at least one imaging sensor. An electronic control unit may be communicatively coupled to the lift actuator and the at least on imaging sensor, the electronic control unit comprising a processor and a non-transitory memory storing a computer readable and executable instruction set. When executed by the processor, the instruction set collects, with the at least one imaging sensor, at least one image of a person to be lifted with the person lifting device; determines a characteristic of the person to be lifted with the person lifting device based on the at least one image; determines an identification of a lift accessory for attachment to the accessory coupling based on the determined characteristic; and, in some embodiments, communicates the identification of the lift accessory.

21 Claims, 8 Drawing Sheets

(52) U.S. Cl.
CPC ..... *A61G 7/1042* (2013.01); *A61G 7/1046* (2013.01); *A61G 7/1051* (2013.01); *A61G 2203/12* (2013.01); *A61G 2205/10* (2013.01); *A61G 2205/60* (2013.01)

(58) Field of Classification Search
CPC .... A61G 7/1051; A61G 7/10; A61G 2205/60; A61G 2203/12; A61G 2205/10
See application file for complete search history.

(56) References Cited

U.S. PATENT DOCUMENTS

| | | | | |
|---|---|---|---|---|
| 6,523,195 | B1 | 2/2003 | Rodier et al. | |
| 7,240,621 | B2 | 7/2007 | Chepurny et al. | |
| 8,538,710 | B2 | 9/2013 | Todd et al. | |
| 8,910,325 | B2 | 12/2014 | Faucher et al. | |
| 2002/0138905 | A1 | 10/2002 | Bartlett et al. | |
| 2006/0234617 | A1* | 10/2006 | Francis | B23D 59/001 452/174 |
| 2009/0049610 | A1 | 2/2009 | Heimbrock et al. | |
| 2009/0307840 | A1 | 12/2009 | Lingegard | |
| 2010/0001838 | A1 | 1/2010 | Miodownik et al. | |
| 2010/0097181 | A1 | 4/2010 | Sorensen et al. | |
| 2010/0192296 | A1 | 8/2010 | Clough | |
| 2010/0217618 | A1 | 8/2010 | Piccirillo et al. | |
| 2010/0224841 | A1 | 9/2010 | Liljedahl | |
| 2011/0035058 | A1 | 2/2011 | Clough | |
| 2011/0301440 | A1 | 12/2011 | Riley et al. | |
| 2012/0029697 | A1 | 2/2012 | Ota et al. | |
| 2012/0095777 | A1 | 4/2012 | Chang et al. | |
| 2013/0019401 | A1 | 1/2013 | Faucher et al. | |
| 2013/0076517 | A1 | 3/2013 | Penninger et al. | |
| 2013/0091631 | A1 | 4/2013 | Hayes et al. | |
| 2013/0205501 | A1 | 8/2013 | Robertson et al. | |
| 2013/0253291 | A1 | 9/2013 | Dixon et al. | |
| 2013/0319775 | A1* | 12/2013 | Ngoh | A61G 7/108 177/1 |
| 2014/0013503 | A1* | 1/2014 | Dixon | A61G 7/1073 5/85.1 |
| 2014/0020175 | A1 | 1/2014 | Dixon et al. | |
| 2014/0115778 | A1* | 5/2014 | Ng | A61G 7/1015 5/83.1 |
| 2014/0192089 | A1* | 7/2014 | Honda | G06T 3/40 345/661 |
| 2014/0210223 | A1* | 7/2014 | Lamela | A61G 7/1061 294/81.5 |
| 2015/0352002 | A1* | 12/2015 | Jeppsson | A61H 31/006 601/41 |
| 2017/0000672 | A1* | 1/2017 | Andersson | A61G 7/1017 |
| 2017/0027794 | A1 | 2/2017 | Andersson et al. | |
| 2017/0027797 | A1 | 2/2017 | Dolliver et al. | |

FOREIGN PATENT DOCUMENTS

| | | | |
|---|---|---|---|
| EP | 2727571 | A2 | 7/2014 |
| WO | 2007075701 | A2 | 7/2007 |
| WO | 2010141865 | A1 | 12/2010 |
| WO | 2015024569 | A1 | 2/2015 |

OTHER PUBLICATIONS

LiftAll; RFID Tagging; [online], www.lift-all.com; (Nov. 2009). p. 1.
Extended European Search Report & Written Opinion dated Feb. 27, 2015 relating to EP Patent Application No. 13176406.0. pp. 1-12.
Non-Final Office Action dated Jun. 12, 2014 relating to U.S. Appl. No. 13/941,161, filed Jul. 12, 2013. pp. 1-10.
Non-Final Office Action dated Feb. 9, 2015 relating to U.S. Appl. No. 13/941,161, filed Jul. 12, 2013. pp. 1-11.
Non-Final Office Action dated Dec. 3, 2015 relating to U.S. Appl. No. 13/941,161, filed Jul. 12, 2013. pp. 1-13.
Non-Final Office Action dated Sep. 10, 2015 relating to U.S. Appl. No. 13/941,179, filed Jul. 12, 2013. pp. 1-9.
Non-Final Office Action dated Nov. 17, 2016 relating to U.S. Appl. No. 13/941,161, filed Jul. 12, 2013. pp. 1-16.
Final Office Action dated Sep. 19, 2016 relating to U.S. Appl. No. 13/941,161, filed Jul. 12, 2013. pp. 1-15.
Non-Final Office Action dated May 16, 2016 relating to U.S. Appl. No. 13/941,161, filed Jul. 12, 2013. pp. 1-13.
Final Office Action dated Apr. 12, 2016 relating to U.S. Appl. No. 13/941,179, filed Jul. 12, 2013. pp. 1-9.
Non-Final Office Action dated Aug. 3, 2016 relating to U.S. Appl. No. 13/941,179, filed Jul. 12, 2013. pp. 1-10.
Final Office Action dated Jan. 30, 2017 relating U.S. Appl. No. 13/941,179, filed Jul. 12, 2013. pp. 1-11.
Extended European Search Report dated Nov. 14, 2016 relating to EP Patent Application No. 16176711.6. pp. 1-12.
Extended European Search Report dated Dec. 9, 2016 relating to EP Patent Application No. 16181917.2. pp. 1-7.
Extended European Search Report dated Nov. 14, 2016 for EP Patent Application No. 16175648.1.

* cited by examiner

PERSON LIFTING DEVICES AND METHODS FOR OPERATING PERSON LIFTING DEVICES

CROSS REFERENCE TO RELATED APPLICATIONS

The present specification claims priority to U.S. Provisional Patent Application Ser. No. 62/187,691 filed Jul. 1, 2015 and entitled "Person Lifting Devices and Methods For Operating Person Lifting Devices," the entirety of which is incorporated herein by reference.

FIELD

The present specification generally relates to person lifting devices, such as mobile lifts and/or overhead lifts, and methods for operating the same.

TECHNICAL BACKGROUND

Person lifting devices, such as mobile lifts and/or overhead lifts, may used in hospitals, other health care facilities, and sometimes in home care settings to move a person from one location to another or to assist the person in moving. Conventional person lifting devices utilize a sling or other attachment to secure a person to the lifting device and an actuator to lift the person to a higher elevation or lower the person to a lower elevation. In one typical example the caregiver operates the actuator to raise the patient off a bed, repositions the person by moving the lifting device to a desired location, and then operates the actuator again to lower the patient to the destination.

Generally, the various accessories for attachment to the person lifting device have a size and/or weight rating. A need exists for alternative methods for insuring that the correct lift accessories are utilized for lifting a person.

SUMMARY

According to one embodiment, a person lifting device may comprise a lift actuator operatively connected to an accessory coupling, whereby the lift actuator raises and lowers the accessory coupling. The person lifting device may also comprise at least one imaging sensor. An electronic control unit may be communicatively coupled to the lift actuator and the at least on imaging sensor, the electronic control unit comprising a processor and a non-transitory memory storing a computer readable and executable instruction set. When executed by the processor, the instruction set collects, with the at least one imaging sensor, at least one image of a person to be lifted with the person lifting device; determines, automatically with the electronic control unit and based on the at least one image, a characteristic of the person to be lifted with the person lifting device; determines, automatically with the electronic control unit and based on the determined characteristic, an identification of a lift accessory for attachment to the accessory coupling; and, in some embodiments, communicates, automatically with the electronic control unit, the identification of the lift accessory.

According to another embodiment, a method for operating a person lifting device may include collecting, with at least one imaging sensor, at least one image of a person to be lifted with the person lifting device. Thereafter, a characteristic of the person to be lifted with the person lifting device is automatically determined with an electronic control unit communicatively coupled to the at least one imaging sensor. The characteristic is determined based on the at least one image. Next, an identification of a lift accessory for attachment to the person lifting device is automatically determined with the electronic control unit based on the determined characteristic. In some embodiments, an identification of the lift accessory is communicated automatically with the electronic control unit to a user of the person lift device.

Additional features of the person lifting devices and methods for operating the person lifting devices described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1A:
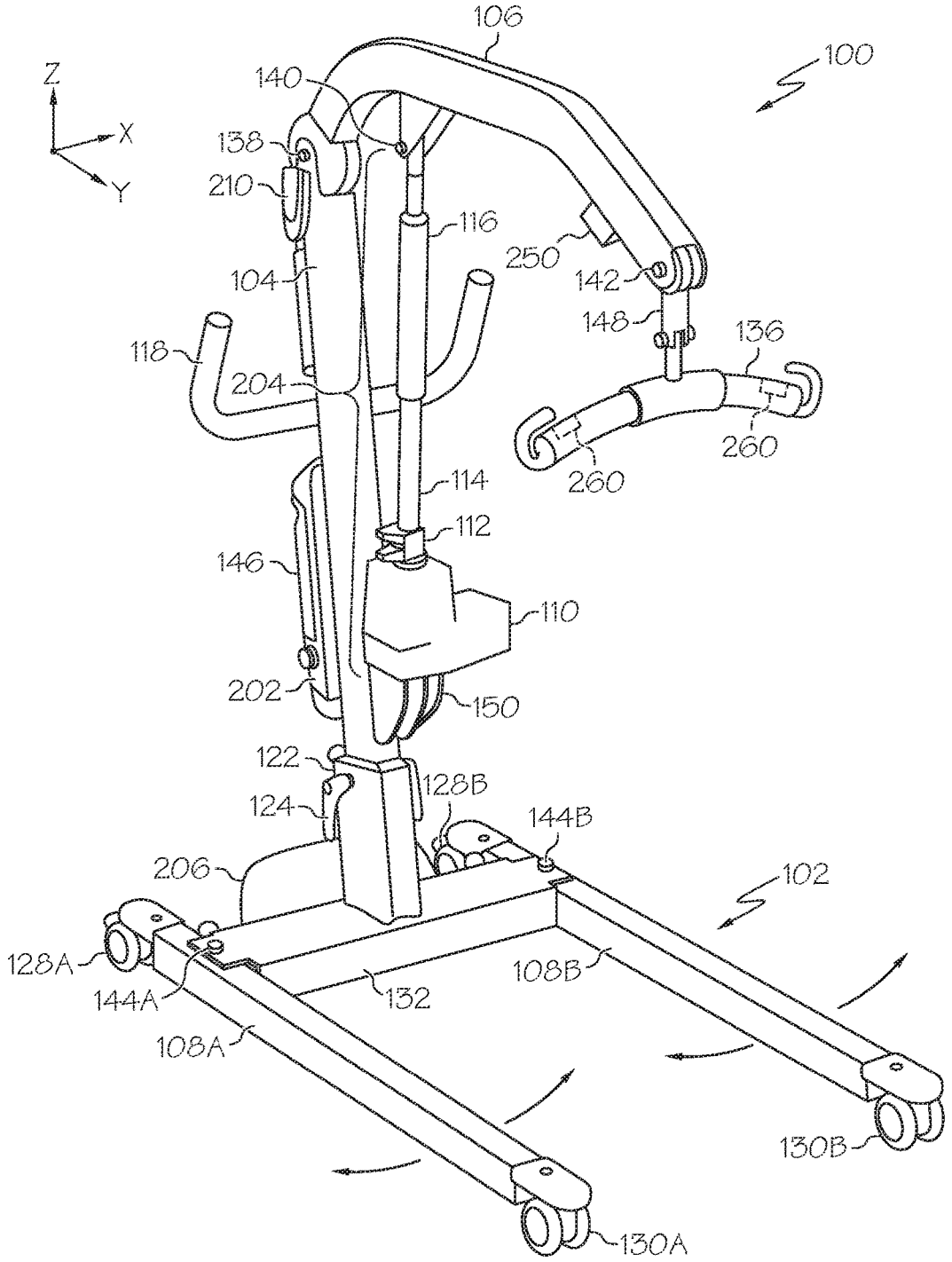
FIG. 1A schematically depicts a front perspective view of a mobile lift according to one or more embodiments shown and described herein.

Reference will now be made in detail to embodiments of person lifting devices and methods of operating the same, examples of which are illustrated in the accompanying drawings. Whenever possible, the same reference numerals will be used throughout the drawings to refer to the same or like parts. One embodiment of a person lifting device is schematically depicted in FIG. 1, and is designated by the reference numeral 100. The person lifting device may generally comprise a lift actuator operatively connected to an accessory coupling, whereby the lift actuator raises and lowers the accessory coupling. The person lifting device may also comprise at least one imaging sensor. An electronic control unit may be communicatively coupled to the lift actuator and the at least on imaging sensor. The electronic control unit generally comprises a processor and a non-transitory memory storing a computer readable and executable instruction set. When executed by the processor, the instruction set collects, with the at least one imaging sensor, at least one image of a person to be lifted with the person lifting device; determines, automatically with the electronic control unit and based on the at least one image, a characteristic of the person to be lifted with the person lifting device; determines, automatically with the electronic control unit and based on the determined characteristic, an identification of a lift accessory for attachment to the accessory coupling; and, in some embodiments, communicates, automatically with the electronic control unit, the identification of the lift accessory. Various embodiments of person lifting devices and methods for operating the same will be described herein with specific reference to the appended drawings.

Figure 1B:
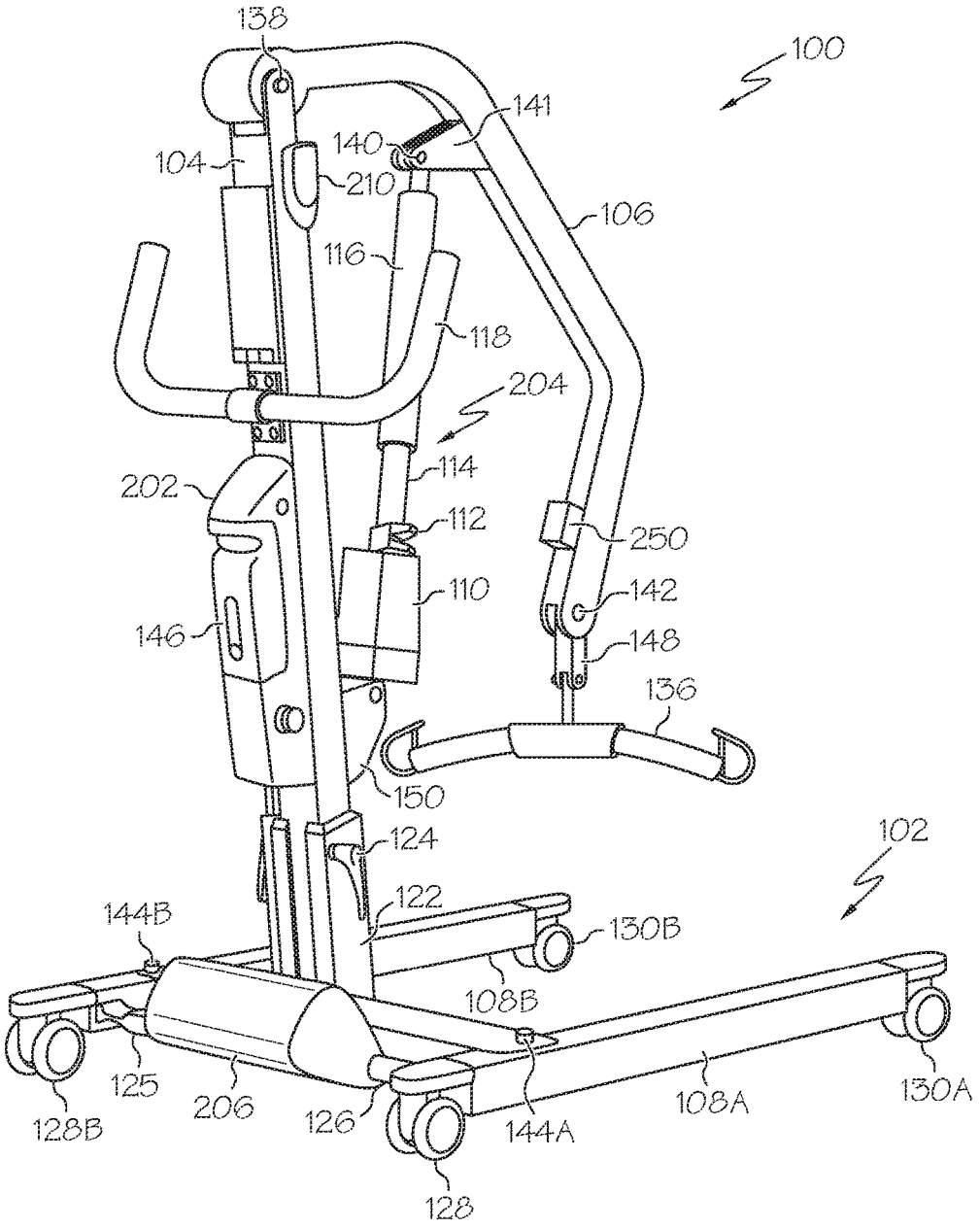
FIG. 1B schematically depicts a rear perspective view of a mobile lift according to one or more embodiments shown and described herein.

Referring now to FIGS. 1A and 1B, one embodiment of a person lifting device 100 is schematically illustrated. The person lifting device 100 may generally comprise a base 102, a lift mast 104 and a lift arm 106. The base may comprise a pair of base legs 108A, 108B which are pivotally attached to a cross support 132 at base leg pivots 144A, 144B such that the base legs 108A, 108B may be pivotally adjusted with respect to the lift mast 104 as indicated by the arrows. The base legs 108A, 108B may be pivoted with the base actuator 206 which is mechanically coupled to both base legs 108A, 108B with base motor linkages 125, 126. In one embodiment, the base actuator 206 may comprise a linear actuator such as a motor mechanically coupled to telescoping threaded rods connected to the base motor linkages 125, 126 such that, when an armature of the motor is rotated, one of the threaded rods is extended or retracted relative to the other. For example, in the configuration shown in FIGS. 1A and 1B, when the rods are extended, the base legs 108A and 108B are pivoted towards one another and, when the rods are retracted, the base legs 108A and 108B are pivoted away from one another. The base legs 108A, 108B may additionally comprise a pair of front castors 130A, 130B and a pair of rear castors 128A, 128B. The rear castors 128A, 128B may comprise castor brakes (not shown).

In one embodiment, the base 102 may further comprise a mast support 122 disposed on the cross support 132. In one embodiment, the mast support 122 may be a rectangular receptacle configured to receive the lift mast 104 of the person lifting device 100. For example, a first end of the lift mast 104 may be adjustably received in the mast support 122 and secured with a pin, threaded fastener, or a similar fastener coupled to the adjustment handle 124. The pin or threaded fastener extends through the mast support 122 and into a corresponding adjustment hole(s) (not shown) on the lift mast 104. Accordingly, it will be understood that the position of the lift mast 104 may be adjusted vertically (e.g., in the +/−Z direction on the coordinate axes shown in FIG. 1A) with respect to the base 102 by repositioning the lift mast 104 in the mast support 122. The lift mast 104 may further comprise at least one handle 118 coupled to the lift mast 104. The at least one handle 118 may provide an operator with a grip for moving the person lifting device 100 on the casters. Accordingly, it should be understood that, in at least one embodiment, the person lifting device 100 is mobile.

The person lifting device 100 may further comprise a lift arm 106 which is pivotally coupled to the lift mast 104 at the lift arm pivot 138 at a second end of the lift mast such that the lift arm 106 may be pivoted (e.g., raised and lowered) with respect to the base 102. FIG. 1A shows the lift arm 106 in the fully raised position while FIG. 1B shows the lift arm in the fully lowered position. The lift arm 106 may comprise at least one lift accessory 136 coupled to the lift arm 106 with an accessory coupling 148 such that the lift accessory 136 is raised or lowered with the lift arm 106. In the embodiment shown in FIGS. 1A and 1B the accessory coupling 148 is pivotally attached to the lift arm 106 at an end of the lift arm 106 opposite the lift arm pivot 138. In one embodiment, the accessory coupling 148 is pivotally attached to the lift arm 106 at attachment pivot 142 such that the lift accessory 136 (a sling bar in the illustrated embodiment) may be pivoted with respect to the lift arm 106. However, it should be understood that, in other embodiments, the accessory coupling 148 may be fixedly attached to the lift arm 106 or that the lift accessory 136 may be directly coupled to the lift arm 106 without the use of an accessory coupling 148.

In the embodiments described herein, the person lifting device 100 is a mechanized lifting device. Accordingly, raising and lowering the lift arm 106 with respect to the base 102 may be achieved using an actuator such as a lift actuator 204. In the embodiments shown, the lift actuator 204 is a linear actuator which comprises a motor 110 mechanically coupled to an actuator arm 114. More specifically, the motor 110 may comprise a rotating armature (not shown) and the actuator arm 114 may comprise one or more threaded rods coupled to the armature such that, when the armature is rotated, the threaded rods are extended or retracted relative to one another and the actuator arm 114 is extended or retracted. In the embodiment shown in FIG. 1, the lift actuator 204 further comprises a support tube 116 disposed over the actuator arm 114. The support tube 116 provides lateral support (e.g., support in the X and/or Y directions) to the actuator arm 114 as the actuator arm 114 is extended. The lift actuator 204 (and base actuator 206) are coupled to an electronic control unit 202 which facilitates actuation and control of both the lift actuator 204 and the base actuator 206.

In the embodiment shown in FIGS. 1A and 1B, the lift actuator 204 is fixedly mounted on the lift mast 104 and pivotally coupled to the lift arm 106. In particular, the lift mast 104 comprises a bracket 150 to which the motor 110 of the lift actuator 204 is attached while the actuator arm 114 is pivotally coupled to the lift arm 106 at the actuator pivot 140. Accordingly, it should be understood that, by actuating the lift actuator 204 with the motor 110, the actuator arm 114 is extended or retracted thereby raising or lowering the lift arm 106 relative to the base 102. In one embodiment, the lift actuator 204 may further comprise an emergency release 112. The emergency release facilitates the manual retraction of the actuator arm 114 in the event of a mechanical or electrical malfunction of the lift actuator 204.

While the embodiments described herein refer to the lift actuator 204 as comprising a motor 110 and an actuator arm 114, it will be understood that the actuator may have various other configurations and may include a hydraulic or pneumatic actuator comprising a mechanical pump or compressor, or a similar type of actuator. Further, in other embodiments, where the lifting device is a cable-based lift system, the actuator may be a motor which pays out and/or takes-up cable thereby raising and/or lowering an attached load. Accordingly, it will be understood that various other types of actuators may be used to facilitate raising and lowering the lift arm and/or an attached load with respect to the base 102.

Still referring to FIGS. 1A and 1B, the person lifting device 100 may further comprise an electronic control unit 202. The electronic control unit 202 may comprise a battery 146 and may be electrically coupled to the lift actuator 204 and the base actuator 206. The electronic control unit 202 may be operable to receive an input from an operator via a control device coupled to the electronic control unit 202. The control device may comprise a wired controller and/or one or more wireless controllers. For example, in one embodiment, the control device may be a wired controller (such as a pendant or the like) or, alternatively, a controller integrated into the electronic control unit 202. In another embodiment, the controller may be a wireless controller such as a wireless hand control and/or a wireless diagnostic monitor/control. Based on the input received from the control device, the control unit is programmed to adjust the position of the lift arm 106 and/or the position of the base legs 108A, 108B by sending electric control signals to the lift actuator 204 and/or the base actuator 206.

In the embodiments described herein, the person lifting device 100 may further include at least one imaging sensor 250. In embodiments, the imaging sensor 250 may be, for example, a digital camera. Suitable digital cameras include, without limitation, CCD cameras, CMOS cameras, 3D cameras, gesture recognition cameras, and range cameras. In embodiments, the digital camera may be communicatively coupled to the electronic control unit 202 and the electronic control unit 202 may include one or more computer readable and executable instruction sets for operating the digital camera. In still other embodiments, the imaging sensor 250 may comprise an optical sensor communicatively coupled to the electronic control unit 202 and a plurality of optical elements, such as lenses and the like, positioned relative to the optical sensor and configured to focus light onto a focal plane of the optical sensor.

In the embodiments described herein, the imaging sensor 250 is located on the person lifting device 100 so as to enable the collection of an image of the person to be lifted with the person lifting device 100 prior to attaching the person to the person lifting device 100 or lifting the person with the person lifting device 100. For example, in the embodiment of the person lifting device depicted in FIGS. 1A and 1B, the imaging sensor 250 is located on an underside of the lift arm 106 and is oriented to capture an image of a person positioned below the lift arm of the person lifting device 100. In another embodiment (not shown), the imaging sensor 250 may be positioned on the lift mast 104. In either embodiment the imaging sensor 250 may be coupled to a mount (not shown) to enable the imaging sensor 250 to be swiveled about one or more rotational axes to permit adjustment of the imaging sensor 250 prior to collection of an image.

While the imaging sensor 250 has been described as being attached to the lift arm 106 or the lift mast 104 of the person lifting device 100 of FIGS. 1A and 1B, it should be understood that other positioning locations on the components of the person lifting device 100 are contemplated and possible. For example, the imaging sensor may be positioned at other locations within the room in which the person lifting device is located. In embodiments, the imaging sensor may be located on the ceiling, walls, or even on a patient support (e.g., a bed).

While FIGS. 1A and 1B depict a person lifting device with a single imaging sensor, it should be understood that, in embodiments, multiple imaging sensors may be utilized and that these imaging sensors may be positioned at different locations with respect to the person lifting device. For example, imaging sensors may be positioned on the person lifting device, the walls of the room, the ceiling of the room, the patient support apparatus, or various combinations thereof.

In the embodiments described herein the imaging sensor 250 is communicatively coupled to the electronic control unit 202 of the person lifting device 100, either by wire or wirelessly. This connection allows the imaging sensor 250 to be activated from the electronic control unit 202 (or from a remote control or pendant associated with the electronic control unit 202) thereby facilitating image collection via the electronic control unit 202. Image data collected with the imaging sensor 250 may be communicated to the electronic control unit 202, either wirelessly or by wire, and stored in a memory operatively associated with the electronic control unit 202 for further processing and analysis.

While FIGS. 1A and 1B depict the person lifting device 100 as a mobile patient lift, it should be understood that the lift control systems and methods for operating a person lifting device described herein may be used in conjunction with other person lifting devices having various other configurations including, without limitation, stationary lifting devices and overhead lifting devices. Further, it should also be understood that, while specific embodiments of the person lifting device described herein relate to person lifting devices used for raising and/or lowering patients, the lift control systems described herein may be used with any lifting device which is operable to raise and lower a load.

Figure 2:
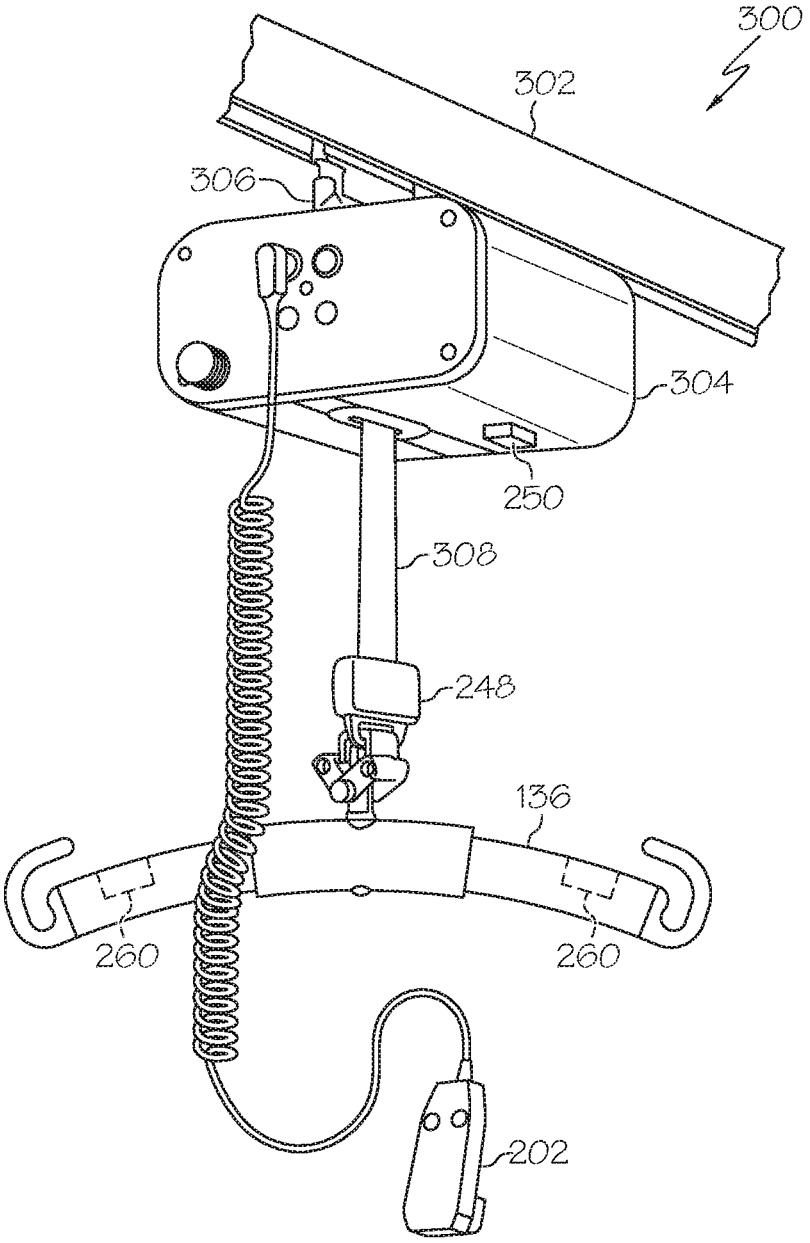
FIG. 2 schematically depicts a perspective view of an overhead lift according to one or more embodiments shown and described herein.
Figure 3:
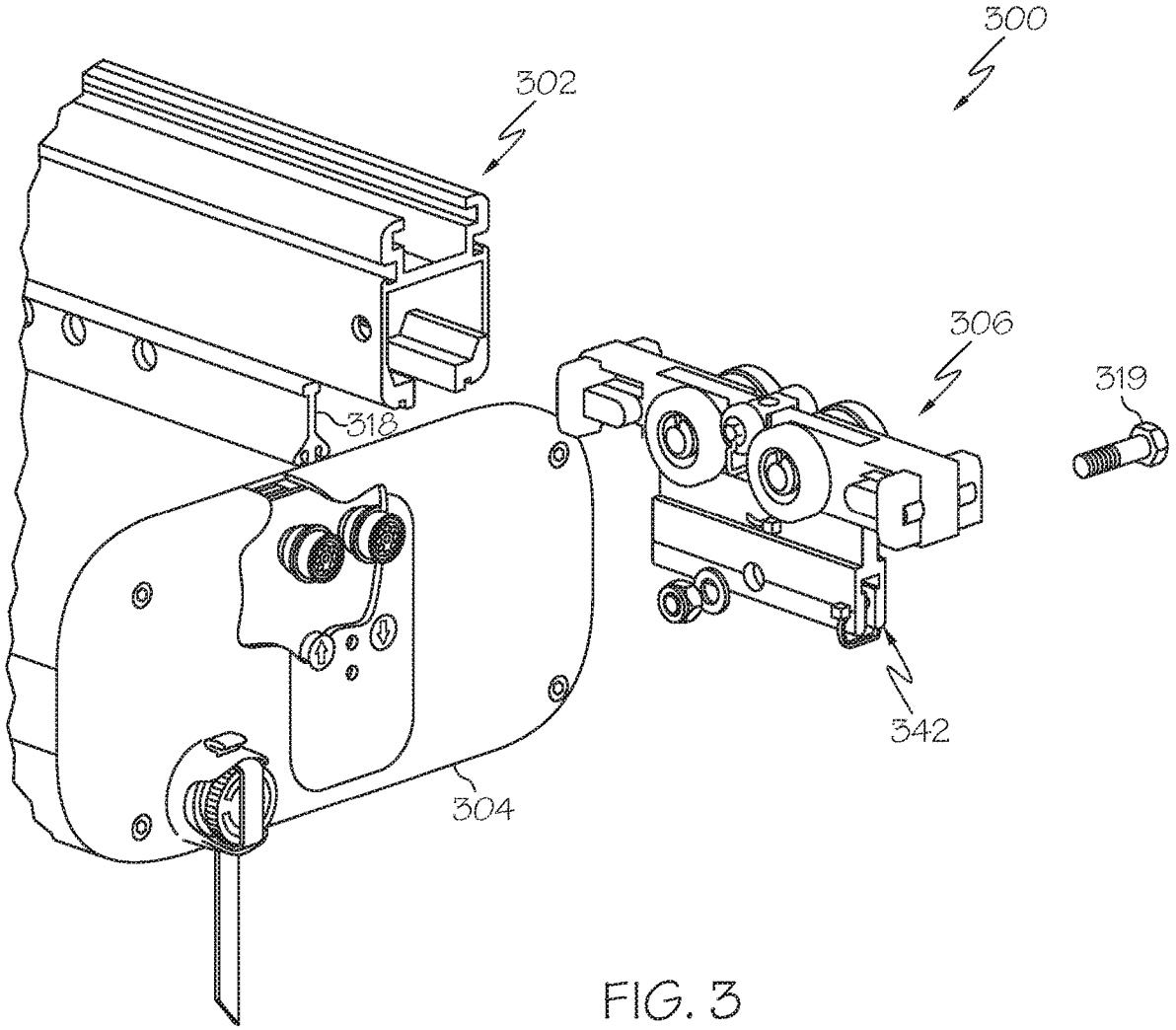
FIG. 3 schematically depicts an exploded view of the overhead lift of FIG. 2.

For example, FIGS. 2 and 3 depict another embodiment in which the person lifting device 300 is a rail-mounted lift system. In this embodiment, the person lifting device 300 generally comprises a lift unit 304 which is slidably coupled to a rail 302 with a carriage 306. The lift unit 304 may be used to support and/or lift a patient with a lifting strap 308 which is coupled to a lift actuator, in this case a motor, contained within the lift unit 304. The lift actuator facilitates paying-out or taking-up the lifting strap 308 from the lift unit 304 thereby raising and lowering a patient attached to the lifting strap 308. For example, an end of the lifting strap 308 may include an accessory coupling 248 to which a lift accessory 136 (i.e., a sling bar in the embodiment shown) may be attached. In the embodiments described herein, the lift unit 304 further includes a battery which is housed in the lift unit 304 and electrically coupled to the lift actuator thereby providing power to the lift actuator 333. However, it should be understood that, in other embodiments, the lift unit 304 may be constructed without the battery, such as when the lift actuator is directly wired to a power source. The person lifting device 300 may further include an electronic control unit 202 which is communicatively coupled to the lift actuator and facilitates actuation and control of the lift actuator, specifically paying out and taking up the lifting strap 308.

In the embodiment of the person lifting device shown in FIGS. 2 and 3, a person may be attached to the lifting strap 308 with a lift accessory 136, such as a sling bar or a similar accessory, attached to the lifting strap 308. For example, a sling bar or a similar accessory may be attached to a harness or sling in which the person is positioned to facilitate the lifting operation. The lift unit 304 may be actuated with the electronic control unit 202 to pay out or take up the lifting strap 308 from the lift unit 304. In the embodiment shown in FIG. 2, the electronic control unit 202 is directly wired to the lift unit 304. However, it should be understood that, in other embodiments, the electronic control unit 202 may be wirelessly coupled to the lift unit 304 to facilitate remote actuation of the lift unit 304.

Referring now to the exploded view of the person lifting device 300 schematically depicted in FIG. 3, the lift unit 304 is mechanically coupled to a carriage 306 which facilitates slidably positioning the lift unit 304 along rail 302. In the embodiments of the lift unit 304 described herein, the lift unit 304 includes a connection rail 318 which is mounted to the top surface of the lift unit 304. The connection rail 318 facilitates connecting and securing the lift unit 304 to the carriage 306. In the embodiment of the lift unit 304 shown in FIG. 3, the connection rail 318 has a T-shaped configuration and the carriage 306 has a receiving slot 342 with a complimentary configuration for receiving the connection rail 318. The carriage 306 may be secured to the connection rail 318 with a fastener 319, such as a bolt and nut as depicted in FIG. 3, which extends transversely through openings in the carriage 306 and a corresponding opening in the connection rail 318.

Figure 4:
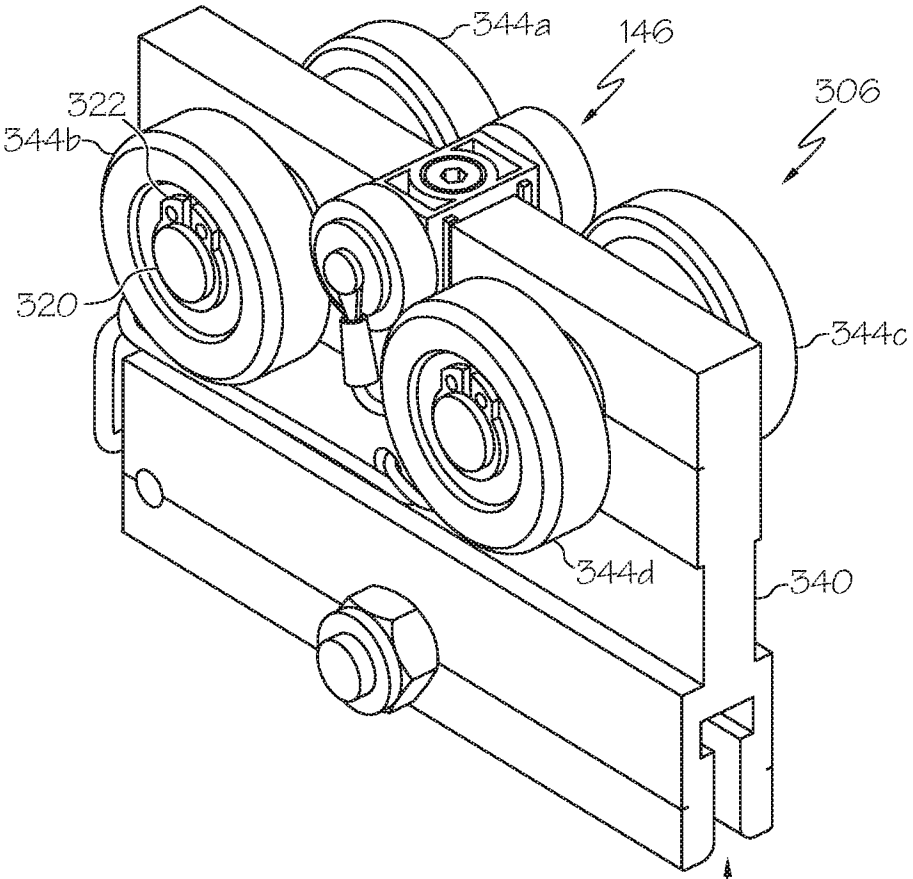
FIG. 4 schematically depicts a carriage of the overhead lift of FIGS. 2 and 3.

Referring now to FIG. 4, the carriage 306 generally comprises a carriage body 340 to which a plurality of support wheels 344*a*, 344*b*, 344*c*, and 344*d* are rotatably attached for supporting the carriage 306 in the rail. The support wheels 344*a*, 344*b*, 344*c*, and 344*d* facilitate positioning the carriage 306 and lift unit along the length of the rail. In the embodiments described herein, the carriage 306 is depicted with four support wheels. However, it is contemplated that the carriage 306 may be constructed with fewer than 4 support wheels. For example, in some embodiments, the carriage may be constructed with one or two support wheels (i.e., a pair of support wheels). Accordingly, it should be understood that the carriage 306 includes at least one support wheel. The support wheels 344*a-d* are positioned on axles 320 which extend transversely through the carriage body 340. Each support wheel is secured to the axle 320 with a fastener, such as retaining clips 322, such that the support wheels are rotatable on the axle 320.

In the embodiment of the carriage 306 depicted in FIG. 4, the support wheels 344*a*, 344*b*, 344*c*, and 344*d* are passive (i.e., the support wheels are not actively driven with a motor or a similar drive mechanism) and the lift unit is manually traversed along the rail. However, in alternative embodiments (not shown), the support wheels may be actively driven such as when the support wheels are coupled to a motor or a similar mechanism. In such embodiments, the drive mechanism may be communicatively coupled to an electronic control unit (such as electronic control unit 202 shown in FIG. 2) which actuates the drive mechanism and facilitates traversing the lift unit along the rail with the drive mechanism.

Referring again to FIG. 2, the person lifting device 300 may further include at least one imaging sensor 250, as described hereinabove. In the embodiment of the person lifting device 300 depicted in FIG. 2, the imaging sensor 250 is located on an underside of the lift unit 304 of the person lifting device 300 so as to enable the collection of an image of the person to be lifted with the person lifting device 300 prior to attaching the person to the person lifting device 300 or lifting the person with the person lifting device 300. For example, in the embodiment of the person lifting device depicted in FIG. 2, the imaging sensor 250 is located on an underside of the lift unit 304 and is oriented to capture an image of a person positioned below lift arm of the person lifting device 100. As described herein, the imaging sensor 250 may be coupled to a mount (not shown) to enable the imaging sensor 250 to be swiveled about one or more rotational axes to permit adjustment of the imaging sensor 250 prior to collection of an image.

While the imaging sensor 250 has been described as being attached to the underside of the lift unit 304 of the person lifting device 300 of FIG. 2, it should be understood that other positioning locations on the lift unit 304 of the person lifting device 300 are contemplated and possible. For example, the imaging sensor may be positioned at other locations within the room in which the person lifting device is located. In embodiments, the imaging sensor may be located on the ceiling, walls, or even on a patient support (e.g., a bed).

While FIG. 2 depicts a person lifting device with a single imaging sensor, it should be understood that, in embodiments, multiple imaging sensors may be utilized and that these imaging sensors may be positioned at different locations with respect to the person lifting device. For example, imaging sensors may be positioned on the person lifting device, the walls of the room, the ceiling of the room, the patient support apparatus, or various combinations thereof.

As described hereinabove, the imaging sensor 250 is communicatively coupled to the electronic control unit 202 of the person lifting device 300, either by wire or wirelessly. This connection allows the imaging sensor 250 to be activated from the electronic control unit 202 (or from a remote control or pendant associated with the electronic control unit 202) thereby facilitating image collection via the electronic control unit 202. Image data collected with the imaging sensor 250 may be communicated to the electronic control unit 202, either wirelessly or by wire, and stored in a memory operatively associated with the electronic control unit 202 for further processing and analysis.

Figure 5:
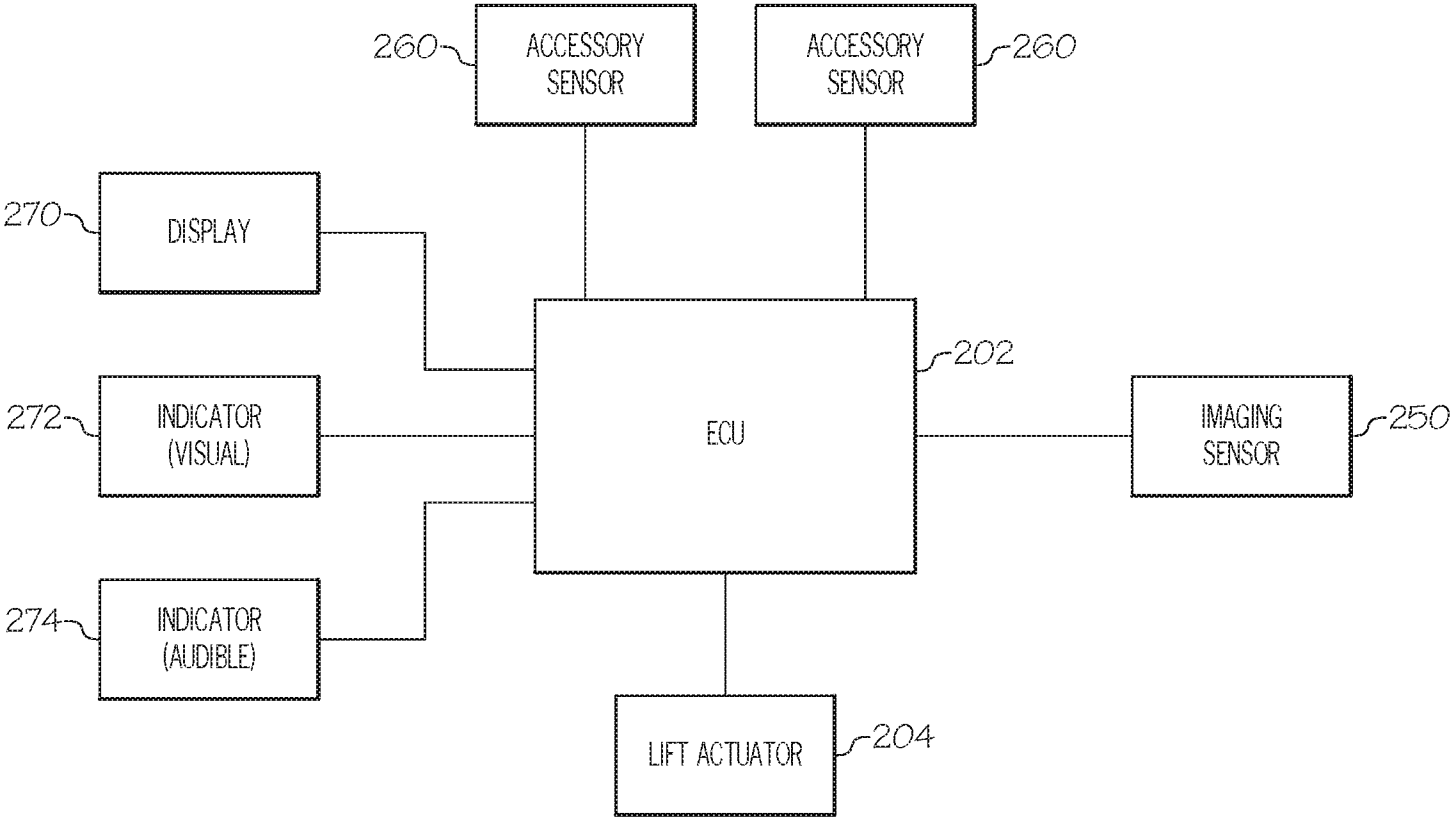
FIG. 5 schematically depicts the interconnectivity of various electrical components of a person lifting device according to one or more embodiments shown and described herein.

Referring now to FIG. 5, one embodiment of an electronic control unit 202 for use with the person lifting device 100 of FIGS. 1A and 1B, or the person lifting device 300 of FIG. 2, is schematically depicted. The electronic control unit 202 includes a processor (not shown) and a non-transitory memory (not shown) which stores computer readable and executable instructions which, when executed by the processor, facilitate the operation of the person lifting device. In the embodiments described herein, the electronic control unit 202 is communicatively coupled (either wired or wirelessly) to the imaging sensor 250 of the person lifting device, facilitating control of the imaging sensor 250 by and through the electronic control unit 202 and the receipt of data (e.g., image data) from the imaging sensor 250 for storage and further processing by the electronic control unit 202. In addition, the electronic control unit 202 is communicatively coupled to the lift actuator 204, facilitating control of the lift actuator 204 by and through the electronic control unit 202 and enabling a person attached to the person lifting device to be raised and/or lowered. In addition, the electronic control unit 202 may be communicatively coupled to a display 270, such as an LCD or LED display, facilitating the display of lift data from the electronic control unit 202. For example, the electronic control unit 202 may display information on the display 270 relating to the type of lift accessories attached to the person lifting device, operating constraints of the person lifting device such as weight limit, lift height, etc., number of lifts performed, service required, and the like. In addition, a visual indicator 272 and/or an audible indicator 274 may be communicatively coupled to the electronic control unit 202 and may be used to provide feedback to an operator of the lift.

Methods of operating the person lifting devices of FIGS. 1A-1B and 2 will now be described in further detail with specific reference to FIGS. 5-7.

In the embodiments described herein, the memory of the electronic control unit 202 may contain computer readable and executable instructions which, when executed by the processor, automatically determine at least one characteristic of a person to be lifted with the person lifting device from at least one image captured with the imaging sensor 250. In embodiments, the at least one characteristic may be, for example, at least one of the height of the person, the weight of the person, whether the person is an amputee, or the like. The electronic control unit 202 utilizes the characteristic to further automatically determine an identification of a suitable lift accessory for attachment to the lift accessory coupling of the lifting device and, in some embodiments, automatically communicates the identification of this lift accessory, such as by displaying a list of suitable accessories on the display communicatively coupled to the electronic control unit 202. The identified lift accessory may be, for example, at least one of a sling bar, a lifting sling, a lifting vest, lifting sheet, and a repositioning sheet, each of which may be specifically designed with certain weight and/or size restrictions.

Figure 6:
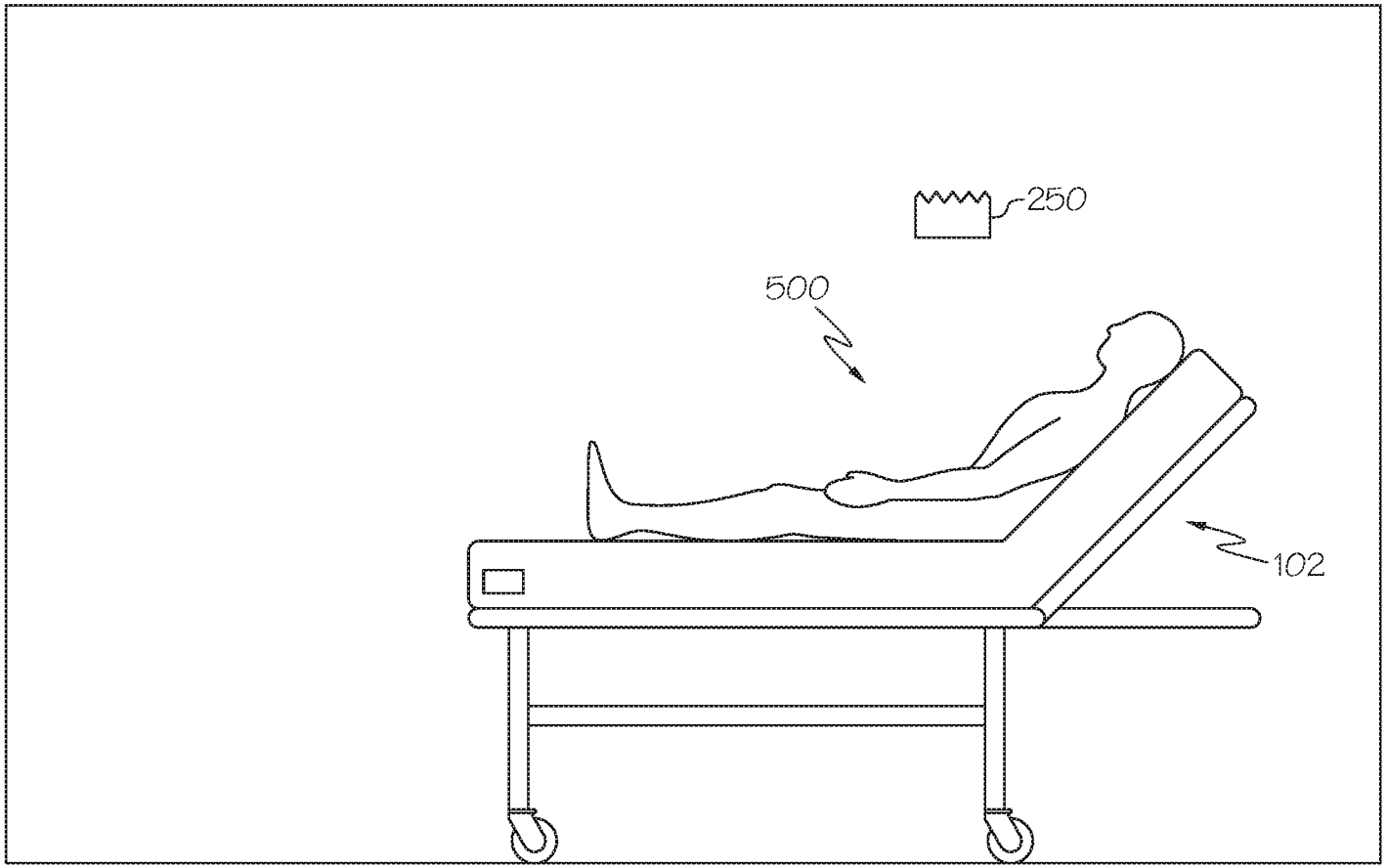
FIG. 6 schematically depicts positioning an imaging sensor of a person lifting device relative to a person to be lifted.
Figure 7:
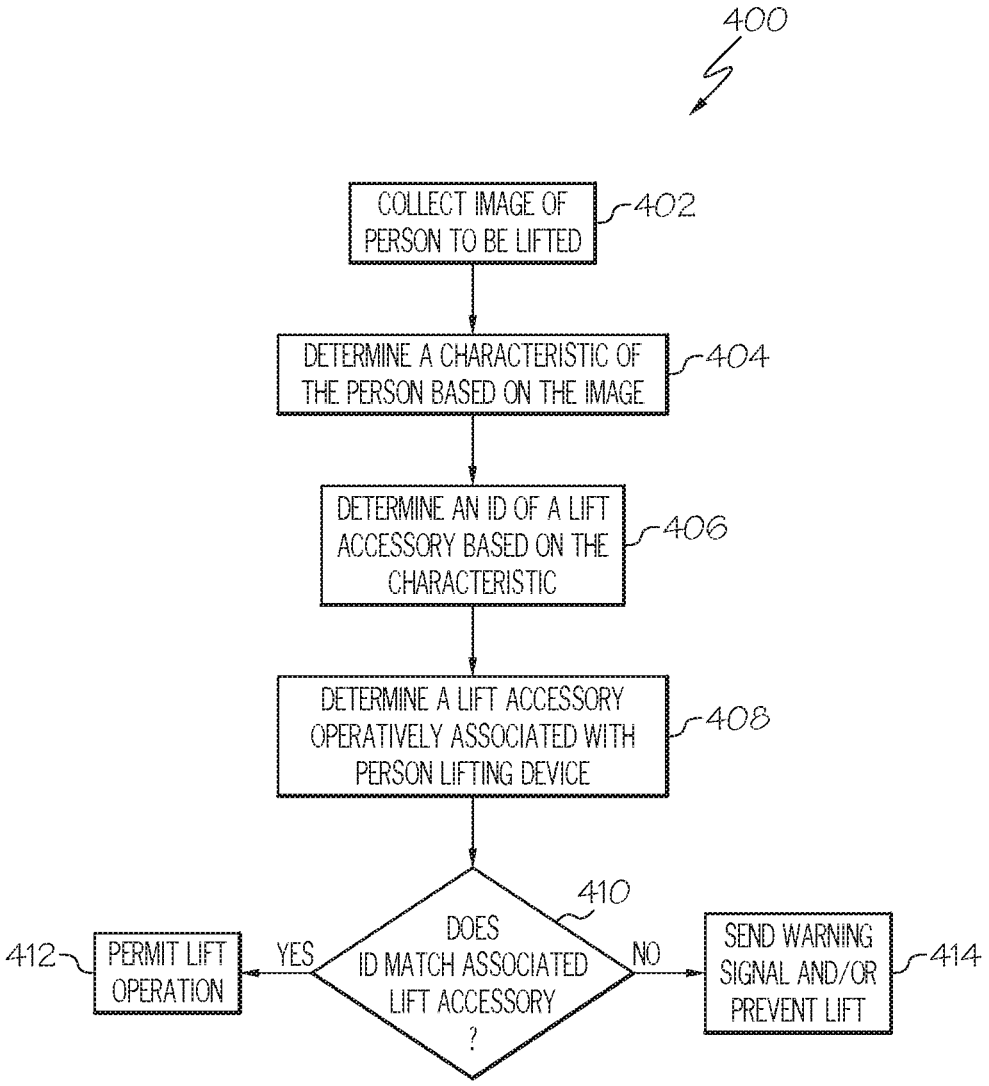
FIG. 7 is a flow diagram of a method for operating a person lifting device according to one or more embodiments shown and described herein.

Still referring to FIGS. 5-7, to operate the person lifting devices described herein, the person lifting device is initially positioned proximate a person 500 to be lifted so that an image of the person can be collected with the imaging sensor 250. For example, in the case of a mobile lift such as the person lifting device 100 schematically depicted in FIG. 1A, the person lifting device 100 may be positioned proximate a patient support (e.g., a bed) such that the imaging sensor 250 is positioned over the person 500. In the case of an overhead lift such as the person lifting device 300 depicted in FIG. 2, the lift unit may be positioned in the corresponding rail such that the imaging sensor 250 is positioned over the person 500.

Thereafter, at step 402 of the flow diagram 400 of FIG. 7, an image of the person 500 to be lifted is collected with the at least on imaging sensor 250. For example, an operator, such as a caregiver, may actuate the imaging sensor 250 with the electronic control unit 202, thereby starting the process of determining an appropriate lift accessory with which to lift the person 500. The collected image is saved to a memory of the electronic control unit 202 for further processing and analysis. In some embodiments, the collected image may also be displayed on the display 270 communicatively coupled to the electronic control unit 202.

Once the image of the person 500 to be lifted is collected, at step 404 the electronic control unit 202 automatically determines a characteristic of the person 500 to be lifted with the person lifting device based on the collected image. For example, the non-transitory memory of the electronic control unit 202 contains image analysis software which automatically operates on a collected image to identify an outline of the person in the image and, based on this outline, determine a characteristic of the person, such as a height of the person, the weight of the person, and/or if the person is, for example, an amputee. For example, through the use of shape/feature recognition and/or various thresholding filters, the image analysis software may determine an outline of the person and, based on the area of this outline in conjunction with known metrics (e.g., tissue and bone densities), determine a height and/or weight of the person and/or determine if the person is missing one or more limbs.

Once the characteristic of the person has been determined, at step 406 the electronic control unit 202 automatically determines an identification of one or more lift accessories for lifting the person 500 based on the determined characteristic. For example, the memory of the electronic control unit may contain a look-up table (LUT) of various lift accessories for attachment to the accessory coupling and indexed according to one or more characteristics (e.g., height and/or weight). The electronic control unit 202 may search this look-up table for lift accessories which have a characteristic corresponding to the determined characteristic and flag these accessories as suitable for use with the person 500. The process of determining an identification of one or more lift accessories may also take into account which accessories are compatible with the person lifting device and/or accessories attached to the person lifting device, further narrowing the number of lift accessories which may be identified based on the determined characteristic of the person to be lifted.

In some embodiments, once at least one suitable lift accessory has been determined, the electronic control unit 202 may optionally automatically communicate an identification of the lift accessory to a user. For example, in some embodiments, the electronic control unit 202 displays the identification of suitable lift accessories for lifting the person 500 on the display 270. In the event that no suitable lift accessory is identified, the electronic control unit 202 may provide the user with a visible and/or audible warning indicative of such using the display 270, visual indicator 272, and/or audible indicator 274. In some embodiments, in addition to providing a warning when no suitable lift accessory is identified, the electronic control unit 202 may lock-out the actuation controls of the person lifting device to prevent the person lifting device from being used until the controls are unlocked or an appropriate override code is entered.

In some embodiments, the electronic control unit 202 may be further programmed to prevent operation of the person lifting device when a lift accessory other than an identified lift accessory is attached to the person lifting device. In these embodiments, the person lifting device may further include one or more accessory sensors 260 which are communicatively coupled to the electronic control unit 202, either by wire or wirelessly. In embodiments, the accessory sensors 260 may be located in the accessory coupling of the lifting device and/or in an accessory of the lifting device, such as a sling bar. For example, in the embodiments of the person lifting device 100 shown in FIG. 1A and the person lifting device 300 shown in FIG. 2, the accessory sensors 260 are located in a lift accessory 136, specifically a sling bar. However, it should be understood that other mounting locations for the accessory sensors are possible, including, without limitation, in or proximate to the accessory coupling. Alternatively, the accessory sensor 260 may be positioned such that the accessory sensor 260 is able to detect an identification of a lift accessory either attached to the person lifting device or a lift accessory located in the vicinity of the person lifting device, such as in the room in which the person lifting device is located. In these embodiments the accessory sensor 260 may be located on, for example, the lift arm 106 or the lift mast 104 of the person lifting device 100 depicted in FIG. 1A, or on the lift unit 304 of the person lifting device depicted in FIG. 2. In the embodiments described herein, the accessory sensor may be an optical detector, an RFID receiver, a bar code scanner, or any other sensor or detector suitable for determining the identification of an attached lift accessory. In these embodiments, the lift accessory (e.g., a sling bar, a lifting sling, a lifting vest, lifting sheet, a repositioning sheet, etc.) may contain identifying indicia or devices compatible with the accessory sensor. For example, the lift accessory may include an RFID tag, a bar code, a QR code or other, similar identifying indicia or device correlated to the identity and characteristics of the lift accessory.

In this embodiment, at step 408, the electronic control unit 202 automatically determines an identity of the selected lift accessory either attached to or located in the general vicinity of the person lifting device using the accessory sensor 260. For example, when the lift accessory contains an RFID tag, the accessory sensor senses and reads the RFID tag and communicates the identification of the selected lift accessory either attached to or located in proximity of the person lifting device to the electronic control unit 202. Thereafter, at step 410, the electronic control unit 202 automatically compares the identification of the selected lift accessory with the identification of the lift accessory determined based on the characteristic of the person to be lifted. In the embodiments described herein, the comparison of the identification of the selected lift accessory with the identification of the lift accessory determined based on the characteristic of the person to be lifted may also take into account the compatibility of the selected lift accessory with the person lifting apparatus and/or other lift accessories attached to the person lifting apparatus.

If the identification of the selected lift accessory is different than the identification of the lift accessory determined based on the characteristic of the person, at step 414 the electronic control unit communicates a visual and/or audible warning signal to the user with the display 270, visual indicator 272, and/or audible indicator 274. In some embodiments, the warning signal may be a communication sent from the electronic control unit to a remote location, such as a nurse's station or the like. In some embodiments, in addition to providing a warning when the identification of the selected lift accessory is different than the identification of the lift accessory determined based on the characteristic of the person, the electronic control unit 202 may lock-out the actuation controls of the person lifting device to prevent the person lifting device from being used until the controls are unlocked or an appropriate override code is entered. At step 412, when the selected lift accessory is the same as the identification of the lift accessory determined based on the characteristic of the person, the electronic control unit permits the lifting operation.

In some embodiments, the electronic control unit 202 may be optionally further programmed to prevent operation of the person lifting device when the characteristic of the person is greater than a threshold characteristic of the person lifting device. For example, the person lifting device may have an upper lift weight threshold. The electronic control unit 202 compares the characteristic of the person, as determined from the collected image, to the threshold characteristic of the person lifting device and, if the characteristic of the person is greater than a threshold characteristic of the person lifting device, the electronic control unit 202 prevents operation of the person lifting device.

More specifically, the electronic control unit 202 may automatically determine a threshold characteristic of the person lifting device which, in the embodiments described herein, may be stored in a memory of the electronic control unit 202 or hard coded into the electronic control unit. Thereafter, the electronic control unit automatically compares the threshold characteristic of the lifting device with the characteristic of the person to be lifted and, if the characteristic of the person to be lifted is greater than the threshold characteristic, the electronic control unit communicates a visual and/or audible warning signal to the user with the display 270, visual indicator 272, and/or audible indicator 274. In this embodiment, in addition to sending a warning if the characteristic of the person to be lifted is greater than the threshold characteristic, the electronic control unit 202 may lock-out the actuation controls of the person lifting device to prevent the person lifting device from being used until the controls are unlocked or an appropriate override code is entered.

Based on the foregoing, it should be understood that the person lifting devices described herein include electronic control units which may be used to identify appropriate lift accessories with which to lift a person by utilizing collected images of the person to be lifted. The collected images are analyzed to determine a characteristic of the person to be lifted and, thereafter, determine which of a plurality of lift accessories are suitable for use in lifting the person. In some embodiments, the electronic control unit may be further programmed to provide a warning or even prevent operation of the person lifting device when an identification of an attached selected lift accessory is different than an identification of a lift accessory determined from the collected images. In further embodiments, the electronic control unit may be programmed to provide a warning or even prevent operation of the person lifting device when the characteristic of the person exceeds a threshold characteristic of the person lifting device.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A person lifting device comprising:

a lift actuator operatively connected to an accessory coupling, whereby the lift actuator raises and lowers the accessory coupling;

at least one imaging sensor; and an electronic control unit communicatively coupled to the lift actuator and the at least one imaging sensor, the electronic control unit comprising a processor and a non-transitory memory storing a computer readable and executable instruction set which, when executed by the processor:

collects, with the at least one imaging sensor, at least one image of a person to be lifted with the person lifting device;

determines, automatically with image analysis software stored on the electronic control unit and based on the at least one image, a characteristic of the person to be lifted with the person lifting device; and determines, automatically with the electronic control unit and based on the determined characteristic, an identification of a lift accessory for attachment to the accessory coupling, wherein the characteristic comprises a weight of the person to be lifted.

2. The person lifting device of claim 1, wherein the computer readable and executable instruction set, when executed by the processor, also:

communicates, automatically with the electronic control unit, the identification of the lift accessory.

3. The person lifting device of claim 1, wherein the computer readable and executable instruction set, when executed by the processor, also:

detects, automatically with an accessory sensor communicatively coupled to the electronic control unit, an identification of a selected lift accessory attached to or in a vicinity of the person lifting device;

compares, automatically with the electronic control unit, the identification of the selected lift accessory with the identification of the lift accessory; and communicates a warning signal when the identification of the selected lift accessory is different than the identification of the lift accessory.

4. The person lifting device of claim 3, wherein the computer readable and executable instruction set, when executed by the processor, also locks-out an actuation control of the person lifting device when the identification of the selected lift accessory is different than the identification of the lift accessory, thereby preventing actuation of the lift actuator.

5. The person lifting device of claim 1, wherein the computer readable and executable instruction set, when executed by the processor, also:

determines, automatically with the electronic control unit, a threshold characteristic of the person lifting device;

compares, automatically with the electronic control unit, the threshold characteristic of the person lifting device with the characteristic of the person to be lifted; and communicates a warning signal when the characteristic of the person to be lifted is greater than the threshold characteristic.

6. The person lifting device of claim 5, wherein the computer readable and executable instruction set, when executed by the processor, also locks-out an actuation control of the person lifting device when the characteristic of the person to be lifted is greater than the threshold characteristic, thereby preventing actuation of the lift actuator.

7. The person lifting device of claim 1 further comprising:

a lift mast mechanically coupled to a base at a first end of the lift mast;

a lift arm pivotally coupled to the lift mast at a second end of the lift mast, wherein the accessory coupling is operatively connected to the lift arm and the lift actuator is mechanically coupled to the lift mast and the lift arm and actuation of the lift actuator raises or lowers the lift arm relative to the base; and the at least one imaging sensor is operatively connected to at least one of the lift arm and the lift mast.

8. The person lifting device of claim 1, further comprising:

a carriage slidably disposed in a rail for relative movement to the rail;

a lift unit coupled to the carriage, the lift unit comprising the lift actuator paying out and taking up a lifting strap, wherein the accessory coupling is attached to an end of the lifting strap; and the at least one imaging sensor is operatively connected to the lift unit.

9. The person lifting device of claim 1, wherein the lift accessory is at least one of a sling bar, a lifting sling, a lifting vest, lifting sheet, and a repositioning sheet.

10. The person lifting device of claim 1, wherein the characteristic further comprises a height of the person to be lifted.

11. A method for operating a person lifting device, the method comprising:

collecting, with at least one imaging sensor, at least one image of a person to be lifted with the person lifting device;

determining, automatically with an electronic control unit communicatively coupled to the at least one imaging sensor and based on the at least one image, a characteristic of the person to be lifted with the person lifting device; and determining, automatically with image analysis software stored on the electronic control unit and based on the determined characteristic, an identification of a lift accessory for attachment to the person lifting device wherein the characteristic comprises a weight of the person to be lifted.

12. The method of claim 11 further comprising:

communicating, automatically with the electronic control unit, an identification of the lift accessory.

13. The method of claim 11, further comprising:

detecting, automatically with an accessory sensor communicatively coupled to the electronic control unit, an identification of a selected lift accessory attached to or in a vicinity of the person lifting device;

comparing, automatically with the electronic control unit, the identification of the selected lift accessory with the identification of the lift accessory; and communicating a warning signal when the identification of the selected lift accessory is different than the identification of the lift accessory.

14. The method of claim 13, further comprising:

locking-out an actuation control of the person lifting device when the identification of the selected lift accessory is different than the identification of the lift accessory, thereby preventing actuation of the person lifting device.

15. The method of claim 14, wherein the warning signal is at least one of a visual warning signal and an audible warning signal.

16. The method of claim 14, wherein the accessory sensor is at least one of a bar code scanner and an RFID receiver communicatively coupled to the electronic control unit.

17. The method of claim 11, further comprising:

determining, automatically with the electronic control unit, a threshold characteristic of the person lifting device;

comparing, automatically with the electronic control unit, the threshold characteristic of the person lifting device with the characteristic of the person to be lifted; and communicating a warning signal when the characteristic of the person to be lifted is greater than the threshold characteristic.

18. The method of claim 17, further comprising:

locking-out an actuation control of the person lifting device when the characteristic of the person to be lifted is greater than the threshold characteristic, thereby preventing actuation of the person lifting device.

19. The method of claim 17, wherein the warning signal is at least one of a visual warning signal and an audible warning signal.

20. The method of claim 11, wherein the lift accessory is at least one of a sling bar, a lifting sling, a lifting vest, lifting sheet, and a repositioning sheet.

21. The method of claim 11, wherein the characteristic further comprises a height of the person to be lifted.

* * * * *